US010228161B2

(12) United States Patent
Bahar et al.

(10) Patent No.: US 10,228,161 B2
(45) Date of Patent: Mar. 12, 2019

(54) ELECTROCHEMICAL COMPRESSOR UTILIZING A PREHEATER

(71) Applicant: Xergy Inc, Georgetown, DE (US)

(72) Inventors: Bamdad Bahar, Georgetown, DE (US); Brian Kienitz, Seaford, DE (US)

( * ) Notice: Subject to any disclaimer, the term of this patent is extended or adjusted under 35 U.S.C. 154(b) by 108 days.

(21) Appl. No.: 15/173,854

(22) Filed: Jun. 6, 2016

(65) Prior Publication Data

US 2016/0341449 A1 Nov. 24, 2016

Related U.S. Application Data

(63) Continuation-in-part of application No. 14/859,267, filed on Sep. 19, 2015, now Pat. No. 9,599,364, which is a continuation-in-part of application No. 13/899,909, filed on May 22, 2013, now abandoned, said application No. 14/859,267 is a continuation-in-part of application No. 14/303,335, filed on Jun. 12, 2014, now abandoned, which is a continuation of application No. 12/626,416, filed on Nov. 25, 2009, now Pat. No. 8,769,972.

(60) Provisional application No. 62/171,331, filed on Jun. 5, 2015, provisional application No. 61/888,785, filed on May 22, 2012, provisional application No. 61/200,714, filed on Dec. 2, 2008.

(51) Int. Cl.

| | |
|---|---|
| ***F24H 4/04*** | (2006.01) |
| ***F24H 9/20*** | (2006.01) |
| ***F25B 30/02*** | (2006.01) |

(52) U.S. Cl.

CPC ..... *F24H 4/04* (2013.01); *F24H 9/2021* (2013.01); *F25B 30/02* (2013.01); *F25B 2339/047* (2013.01)

(58) Field of Classification Search

CPC ..... F24H 4/04; F24H 9/2021; F25B 30/02; F25B 2339/047; F25B 29/00

See application file for complete search history.

(56) References Cited

U.S. PATENT DOCUMENTS

| | | | | |
|---|---|---|---|---|
| 6,321,561 | B1 * | 11/2001 | Maget | F03G 7/005 417/379 |
| 2002/0066277 | A1 * | 6/2002 | Tsenter | F04B 35/00 62/46.2 |
| 2003/0196893 | A1 * | 10/2003 | McElroy | C25B 1/02 204/266 |

* cited by examiner

*Primary Examiner* — Elizabeth J Martin

(74) *Attorney, Agent, or Firm* — Invention to Patent Services; Alex Hobson

(57) ABSTRACT

An electrochemical compression system utilizes a preheater to heat an electrochemically active working fluid to a superheated temperature delta prior compression. Heating the electrochemically active working fluid to a superheated temperature ensures there will be no condensation before the fluid reaches the condenser and therefore increases efficiency and effectiveness of the system. A preheater may be configured in a chamber upstream of the electrochemical compressor and one or more valves may control the delivery of the superheated fluid to the compressor. A preheater may be configured in an enclosure, having a valve at the inlet and outlet and retain the electrochemically active fluid at a superheated temperature. A preheater may be configured within or attached to a gas diffusion media, flow-filed or current collector and may be in direct communication with the fluid.

22 Claims, 11 Drawing Sheets

ELECTROCHEMICAL COMPRESSOR UTILIZING A PREHEATER

CROSS-REFERENCE TO RELATED APPLICATIONS

This application claims the benefit of provisional patent application No. 62/171,331, filed on Jun. 5, 2015 and entitled Electrochemical Compressor Utilizing a Preheater, and is a continuation in part of U.S. patent application Ser. No. 14/859,267, filed on Sep. 19, 2015, entitled Electrochemical Compressor Based Heating Element and Hybrid Hot Water Heater Employing Same and currently pending, which is a continuation in part of U.S. patent application Ser. No. 13/899,909 filed on May 22, 2013, entitled Electrochemical Compressor Based Heating Element And Hybrid Hot Water Heater Employing Same, which claims the benefit of U.S. provisional patent application No. 61/688,785 filed on May 22, 2012 and entitled Electrochemical Compressor Based Heat Pump For a Hybrid Hot Water Heater, and application Ser. No. 14/859,267 is also a continuation in part of U.S. Ser. No. 14/303,335, filed on Jun. 12, 2014, entitled Electrochemical Compressor and Refrigeration System and now abandoned, which is a continuation of U.S. patent application Ser. No. 12/626,416, filed on Nov. 25, 2009, entitled Electrochemical Compressor and Refrigeration System and currently issued as U.S. Pat. No. 8,769,972, and which claims the benefit of U.S. provisional patent application No. 61/200,714, filed on Dec. 2, 2008 and entitled Electrochemical Compressor and Heat Pump System; the entirety of each related application is hereby incorporated by reference.

BACKGROUND OF THE INVENTION

1. Field of the Invention

The present invention relates to an electrochemical compressor system comprising a preheater that superheats the working fluid before compression occurs to reduce or eliminate condensation of the working fluid before it reaches the condensing unit in a vapor compression cycle.

2. Background

The function of both refrigeration cycles and heat, pumps is to remove heat from heat source or reservoir at low temperature and to reject the heat to a heat sink or reservoir at high temperature. While many thermodynamic effects have been exploited in the development of heat pumps and refrigeration cycles, one of the most popular today is the vapor compression approach. This approach is sometimes called mechanical refrigeration because a mechanical compressor is used in the cycle.

Mechanical compressors account, for approximately 30% of a household's energy requirements and thus consume a substantial portion of most utilities' base load power. Any improvement in efficiency related to compressor performance can have significant benefits in terms of energy savings and thus have significant positive environmental impact. In addition, there are increasing thermal management problems in electronic circuits, which require smaller heat pumping devices with greater thermal management capabilities.

Vapor compression refrigeration, cycles generally contain five important components. The first is a mechanical compressor that is used to pressurize a gaseous working fluid.

After proceeding through the compressor, the hot pressurized working fluid is condensed in a condenser. The latent heat of vaporization of the working fluid is given up to a high temperature reservoir often called the sink. The liquefied working fluid is then expanded at substantially constant enthalpy in a thermal expansion valve or orifice. The cooled liquid working fluid is then passed through an evaporator. In the evaporator, the working fluid absorbs its latent heat of vaporization from a low temperature reservoir often called a source. The last element in the vapor compression refrigeration cycle is the working fluid itself.

In conventional vapor compression cycles, the working fluid selection is based on the properties of the fluid and the temperatures of the heat source and sink. The factors in the selection include the specific heat of the working fluid, its latent heat of vaporization, its specific volume and its safety. The selection of the working fluid affects the coefficient of performance of the cycle.

For a refrigeration cycle operating between a lower limit, or source temperature, and an upper limit, or sink temperature, the maximum efficiency of the cycle is limited to the Carnot efficiency. The efficiency of a refrigeration cycle is generally defined by its coefficient of performance, which is the quotient of the heat absorbed from the sink divided by the network input required by the cycle.

Any improvement in refrigeration systems clearly would have substantial value. Electrochemical energy conversion is considered to be inherently better than other systems because due to their relatively high exergetic efficiency. In addition, electrochemical systems are considered to be noiseless, modular, and scalable and can provide a long list of other benefits depending on the specific thermal transfer application.

SUMMARY OF THE INVENTION

Water based vapor phase compression systems utilizing an electrochemical compressor are described in U.S. Pat. No. 9,005,411, entitled Electrochemical Compression System, U.S. Pat. No. 8,769,972, entitled Electrochemical Compressor And Refrigeration System, U.S. Pat. No. 8,627,671, entitled Self-Contained Electrochemical Heat Transfer System, and U.S. application Ser. No. 13/899,909, entitled Electrochemical Compressor Based Heating Element and Hybrid Hot Water Heater Employing Same, all of which are assigned to Xergy Inc; the entirety each reference is incorporated by, reference herein. As described in these references, the working fluid is composed of two components, the electro-active component, frequently hydrogen, and a co-working fluid providing the phase change in the cycle.

In a water based vapor phase compression cycle heat pump using an electrochemical compressor, the working fluid is composed of two components the electro-active component, frequently H2, and a co-working fluid providing the phase change in the cycle. In modeling and experimentation, it is apparent that, unlike in a mechanical compressor, an electrochemical compressor doesn't significantly increase the temperature of the working fluid during the compression stage. Therefore, if no extra heat is added to the working fluid the working fluid will condense across the compressor before it can reach the condenser heat exchanger; thereby significantly reducing the efficiency of the heat pump system. This limitation can be overcome and efficiency can be greatly increased by increasing the temperature of the working fluid above the high pressure condensing temperature of the working fluid before it reaches the high pressure side of the electrochemical compressor.

In an exemplary embodiment, the present invention incorporates a preheater prior to the electrochemical compressor to superheat the working fluid to a superheated temperature. Superheated working fluid is a working fluid, in a gas phase, that is at a temperature higher than its vaporization (boiling) point at the absolute pressure where the temperature is measured. Increasing the temperature of the working fluid to a superheated temperature greatly reduces the possibility that the working fluid, or components thereof, will condense prior to reaching the condenser. Working fluid that condense before the condenser reduces the efficiency of the system. A working fluid may be heated to a superheated temperature delta, or a temperature differences, delta, above the vaporization temperature at the absolute pressure, or pressure prior to the electrochemical compressor, on in an inlet chamber to the electrochemical compressor. A preheater may heat the working fluid to a superheated temperature delta of about 5° C. or more 10° C. or more, about 20° C. or more, about 30° C. or more, about 40° C. or more, about 60° C. or more and any range between and including these values. For example, if the vaporization temperature or boiling point temperature of a working fluid or a component thereof is 100° C. at the pressure of the inlet of the electrochemical compressor, then a superheated temperature delta of 20° C. means that the temperature of the working fluid is 120° C.

An exemplary electrochemical compressor and heat pump system includes an electrochemical cell and a gas refrigerant-based cooling system. The electrochemical cell is capable of producing high pressure gas from the local mixed fluid system of hydrogen and a working fluid, for example. The heat pump system can include a condenser, compressor, and evaporator in thermal communication with an object to be cooled or heated. The working fluid gas is pressurized across the membrane electrode assembly by electro-osmotic pumping. As the vapor refrigerant is compressed, it is forced through the condenser where the refrigerant is liquefied and heats the material in contact with the condenser. The liquid refrigerant then passes through the evaporator where the liquid refrigerant is evaporated by absorbing heat from the object to be cooled. The working fluid then enters the electrochemical compressor where the cycle is repeated.

The present invention incorporates a preheater to provide additional heat to the working fluid after it leaves the evaporator and before it is compressed in the compressor. The working fluid may be heated before it enters the compressor or after the working fluid has entered the compressor, but before compression occurs. The anode side of an electrochemical compressor, or low pressure side, may be in fluid communication with an inlet chamber for receiving the incoming working fluid. The working fluid may be heated by the preheater prior to entry into the inlet chamber or may be heated by a preheater while in the inlet chamber. The inlet chamber may be thermally insulated to enable more efficient heating of the working fluid or to more effectively retain the working fluid at a superheated temperature delta. A flow valve may be configured to open, and close to allow a flow of working fluid into the inlet chamber. In an exemplary embodiment, a one-way flow valve may be configured to allow working fluid to flow into the inlet chamber and not back out of the inlet chamber. The inlet chamber becomes an inlet enclosure when a flow valve is closed to trap working fluid within the inlet enclosure. A control system may control the opening and closing of a flow valve as a function of the temperature of the working fluid in the inlet chamber or enclosure, or as a function of pressure of the working fluid.

A preheater may be configured prior to the working fluid entering the inlet chamber or configured to heat the working fluid within the inlet chamber. A preheater may comprise an electrically resistive element that is configured around a conduit of flow channel of the working fluid, and may be an array of wires or a rod, for example. A preheater may comprise a heating element that is in direct contact with the working fluid, such as a resistive element within a conduit or inlet chamber, coupled to a flow-field or current collector or along the interior walls of a flow conduit or chamber. In an exemplary embodiment, a current collector and/or flow-field may be configured with resistive elements to heat the working fluid to a superheated temperature delta. A flow field comprises a channel or plurality of channels for distributing the working fluid to the anode and these small channels may be an effective and efficiency area for heating the working fluid to a superheated temperature delta. A resistive element may be configured along the channel, such as along the interior wall of the channel or any suitable location in or attached to a flow-field to heat the working fluid as it flows through the channels. A preheater may also use any waste heat from the system, such as from the condenser to heat the working fluid. Utilization of heat from the condenser may reduce the power and energy requirements for heating the working fluid to a superheated temperature delta.

An electrochemically active working fluid comprises an electrochemically active component that will react with the anode, whereby a portion of the product of the reaction at the anode is passed through the ion exchange membrane where it is reacted at the cathode. Water is a preferred electrochemically active working fluid as it can readily be electrolyzed and reformed, as described herein, near room temperatures. The hydrogen is provided to the anode side of a fuel cell, such as a polymer electrolyte membrane (PEM) fuel cell, where it reacts with the anode and is converted into protons. Water is an electrochemically active working fluid that is both electrochemically active and is a refrigerant. Other electrochemically active fluids may comprise alcohol, such as methanol, or may comprise ammonia.

The compression and subsequent flow the electrochemically active working fluid can be used in a heat transfer system. In an exemplary embodiment, the heat transfer system comprises a condenser, an expansion valve and an evaporator. The condenser may be used to heat an object or the air in an enclosure, for example, and likewise, the evaporator may be used to cool an object or air in an enclosure. A heat transfer system utilizing a compression system as described herein may be incorporated into a refrigerator or heat pump system. Heat transfer from a heat transfer device to a heat reservoir may be through conduction or convention. A heat sink may contact a condenser and draw heat from the condenser and a fan may blow over an evaporator to add heat to the evaporator through convection.

A control system may be coupled with various components of the compressor and/or heat transfer system to control various functions. In an exemplary embodiment, a user interface having a temperature set point input provides an input to the control system. The control system may then control the operation of the compressor system to heat or cool as required by the user input. The control system may monitor the pressures and temperatures throughout the system and control the rate of flow of working fluid through control of the power to the electrochemical compressor or through the control of valves. The control system may regulate a pressure valve of the conduit and thereby control the flow of the electrochemically active working fluid through the system. A control system may comprise a microprocessor and various user interfaces for programing the system.

An exemplary electrochemical cell comprises a polymer electrolyte membrane comprising polar ionic groups attached to nonpolar chains. Examples of this type of ionomer are sulfonated perfluorinated polymer or a sulfonated polymer. An ion exchange membrane may comprise an ionomer that is mechanically reinforced with a non-ionic fibrous material, such as a polymer membrane and particularly expanded polytetrafluoroethylene (PTFE). A mechanically reinforced ionomer membrane may be desired to better resist pressure differences between the anode and cathode side of the electrochemical cell and/or to minimize the cost of the expensive ionomer material. In an exemplary embodiment, the membrane electrode assembly (MEA) utilized in the electrochemical compressor is a classical ionomer membrane with electrodes attached, a membrane electrode assembly, or MEA. The membrane electrode assembly functions as a compressor component in a traditional four-stage refrigeration cycle system.

An exemplary electrochemical refrigeration of cooling system can include a condenser, compressor, and evaporator in thermal communication with an object to be cooled. In an exemplary embodiment, water is the electrochemically active working fluid. The water in gas form is pressurized across the membrane electrode assembly by the local use of hydrogen for electro-osmotic pumping. After the vapor refrigerant is compressed it is forced through the condenser where the refrigerant is liquefied. The liquid refrigerant then passes through the evaporator where the liquid refrigerant is evaporated by absorbing heat from the object to be cooled. The working fluid then enters the electrochemical cell where the cycle is repeated. In this case, the hydrogen is formed and consumed in the compressor unit before a reaches the condenser.

The summary of the invention is provided as a general introduction to some of the embodiments of the invention, and is not intended to be limiting. Additional example embodiments including variations and alternative configurations of the invention are provided herein.

The accompanying drawings are included to provide a further understanding of the invention and are incorporated in and constitute a part of this specification, illustrate embodiments of the invention, and together with the description serve to explain the principles of the invention.

Figure 4:
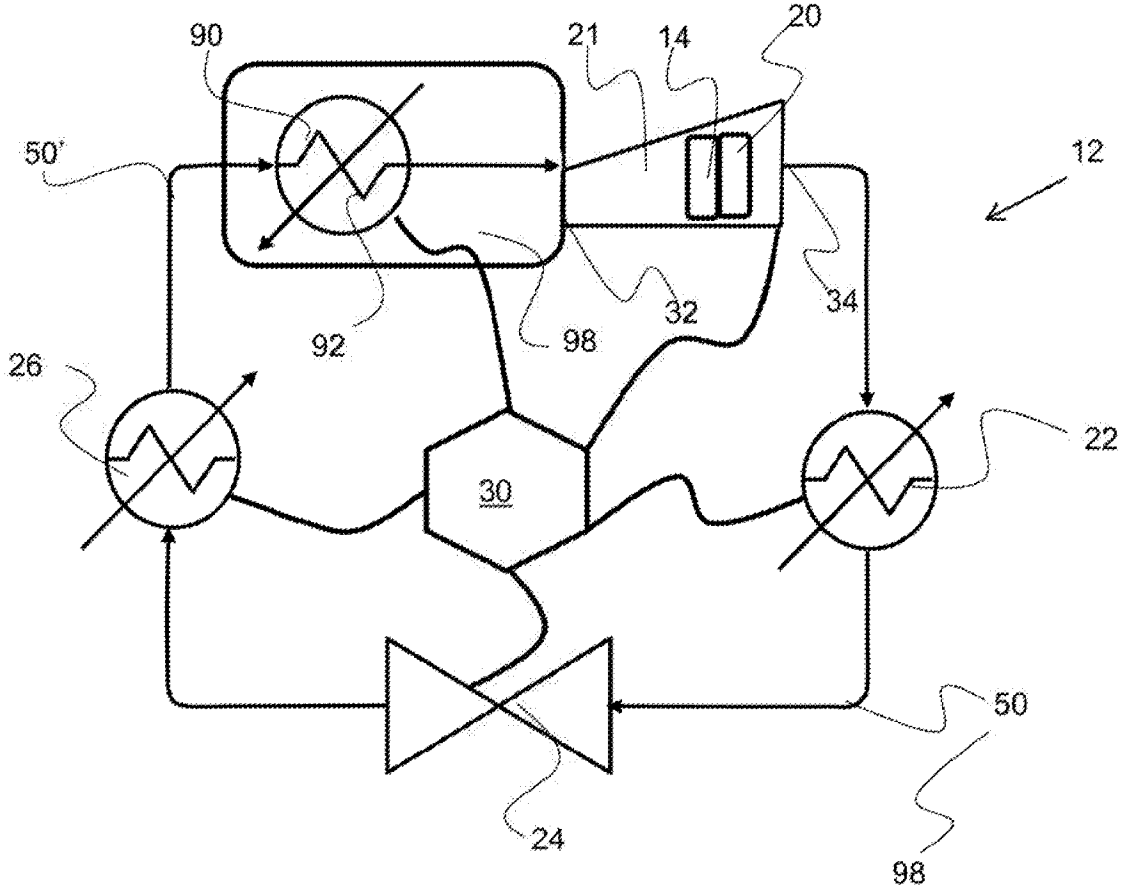

FIG. 4 snows diagram of an electrochemical heat transfer system comprising an electrochemical compressor, preheater and an inlet chamber.

Figure 5:
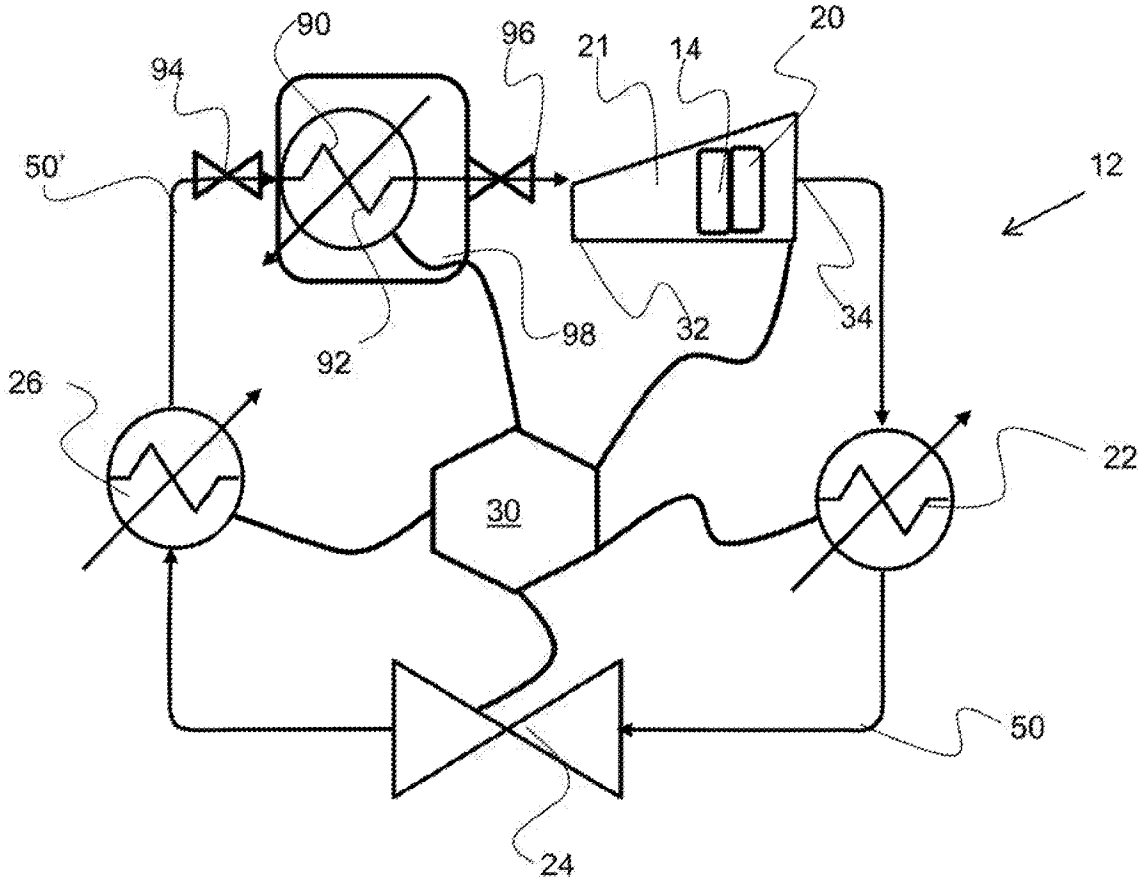

FIG. 5 shows diagram of an electrochemical heat transfer system comprising an electrochemical compressor, preheater, inlet chamber and inlet valves.

Figure 6:
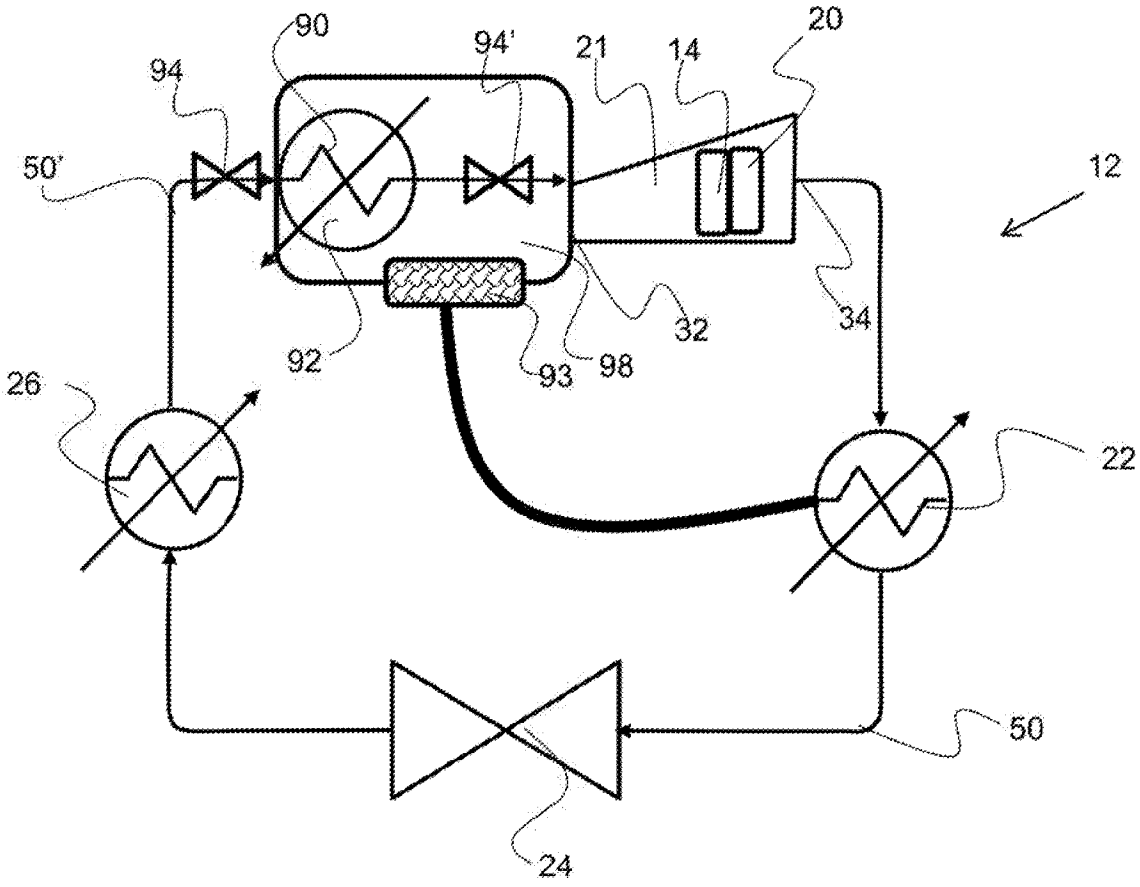

FIG. 6 shows diagram of an electrochemical heat transfer system comprising an electrochemical compressor, preheater, inlet chamber and a waste heat device.

Figure 7:
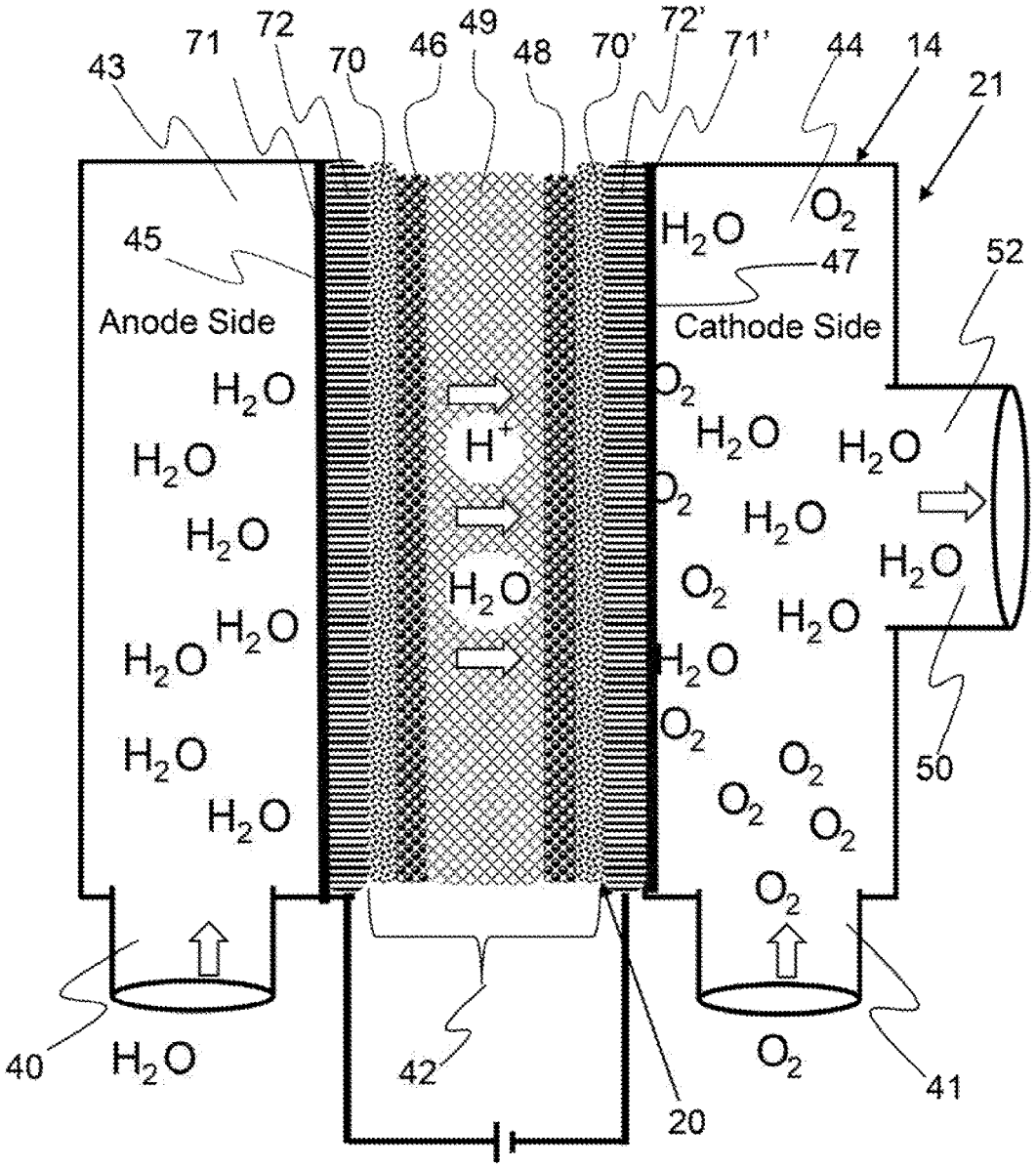

FIG. 7 shows a diagram of an electrochemical compressor.

Figure 8:
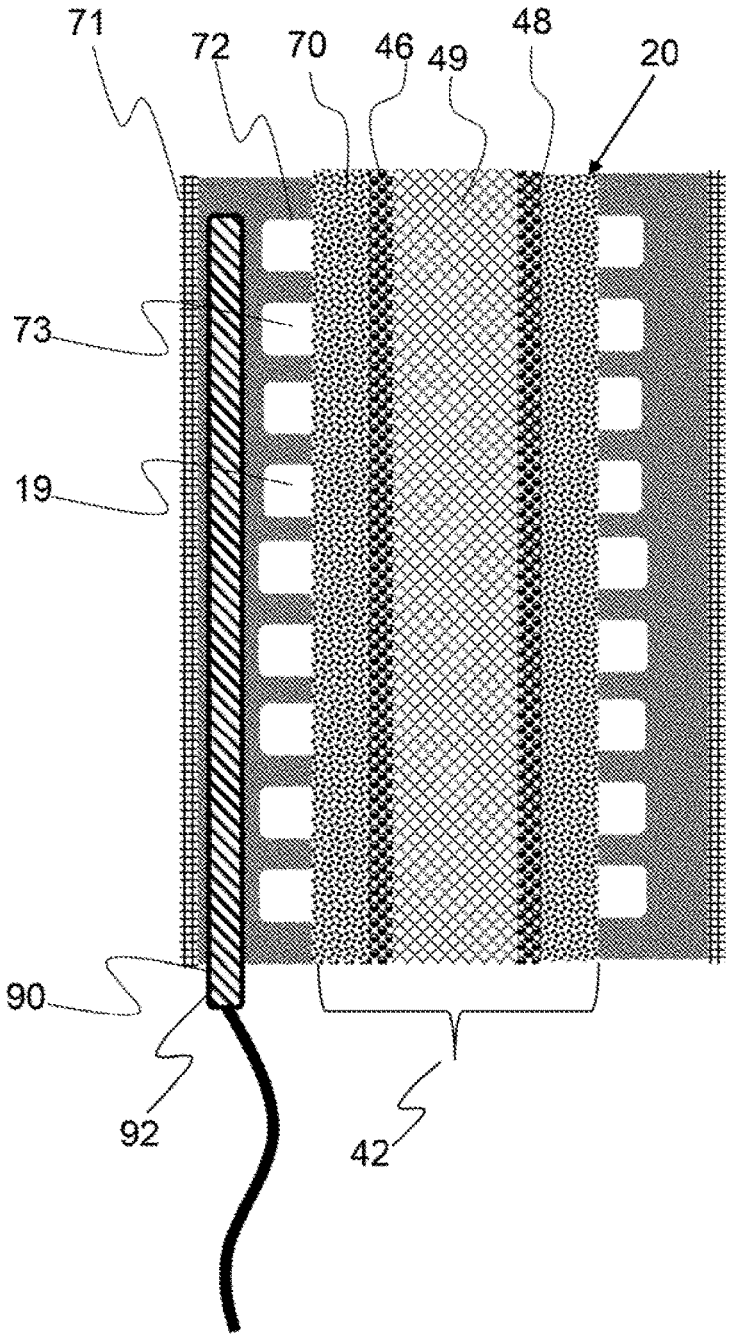

FIG. 8 shows a sectional view of a flow-field with a preheater configured to heat the flow field.

Figure 9:
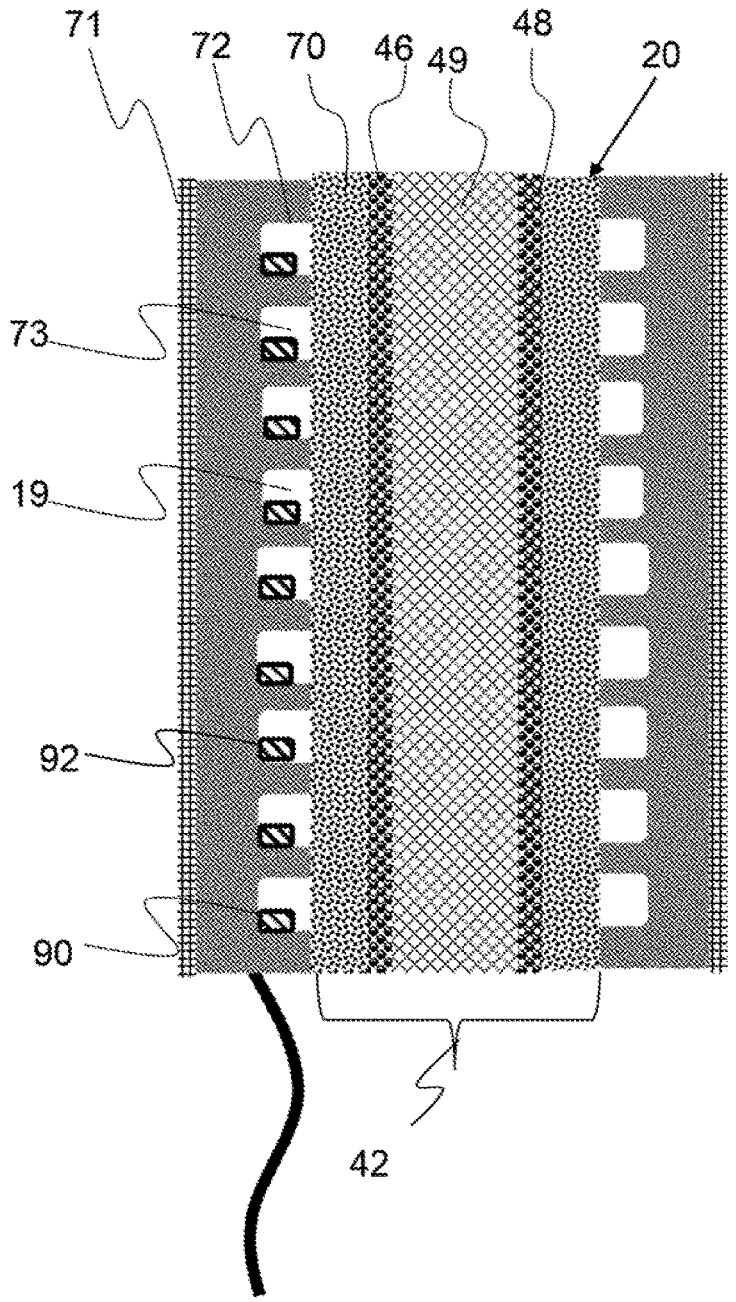

FIG. 9 shows a sectional view of a flow-field with a preheater heater element within the flow channels.

Figure 10:
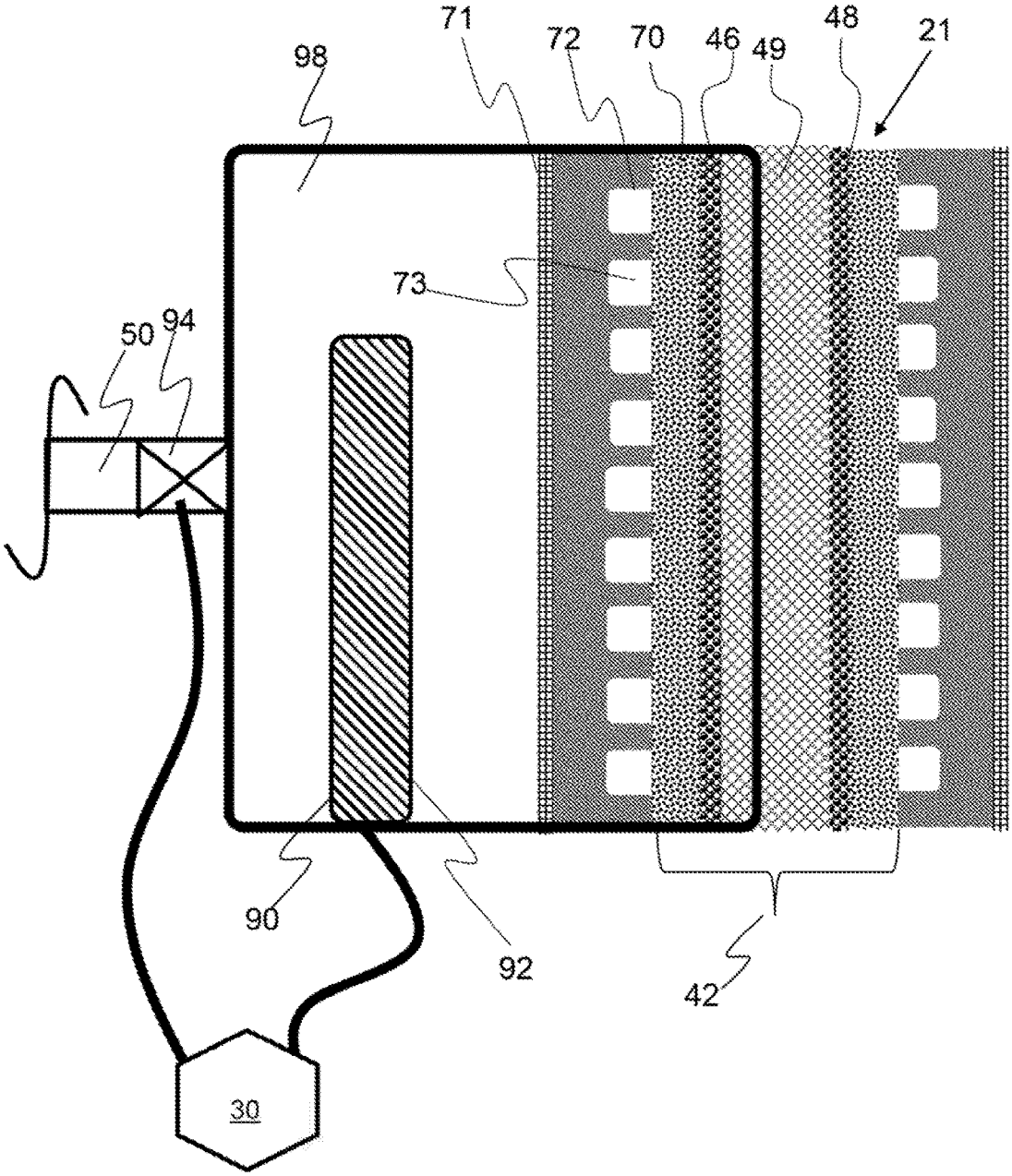

FIG. 10 shows a sectional view of a portion of an electrochemical compressor having a preheater in an inlet chamber.

Figure 11:
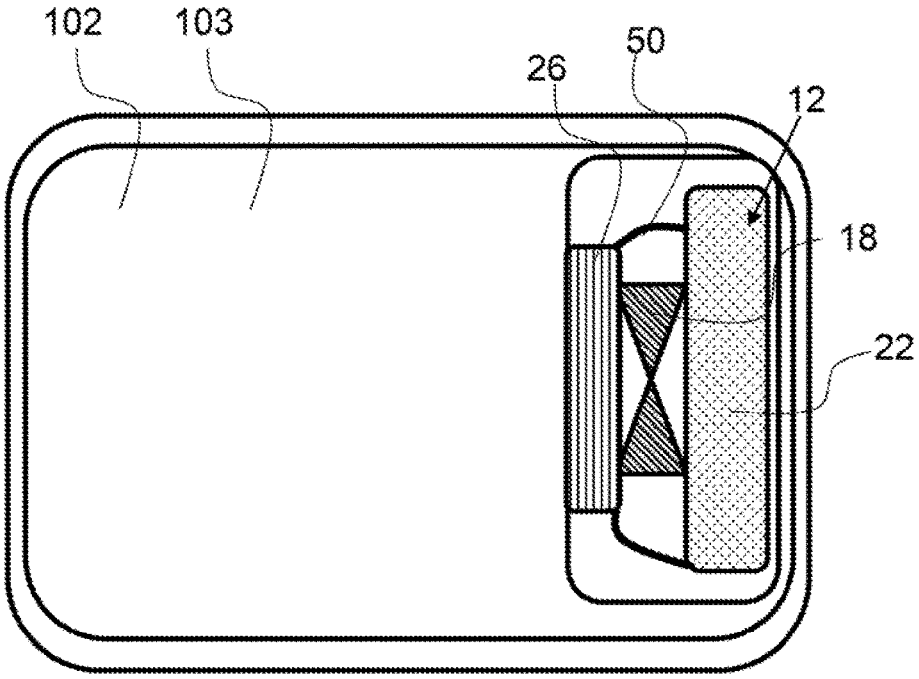

FIG. 11 shows an exemplary electrochemical heat transfer system configured in a refrigerator.

Figure 12:
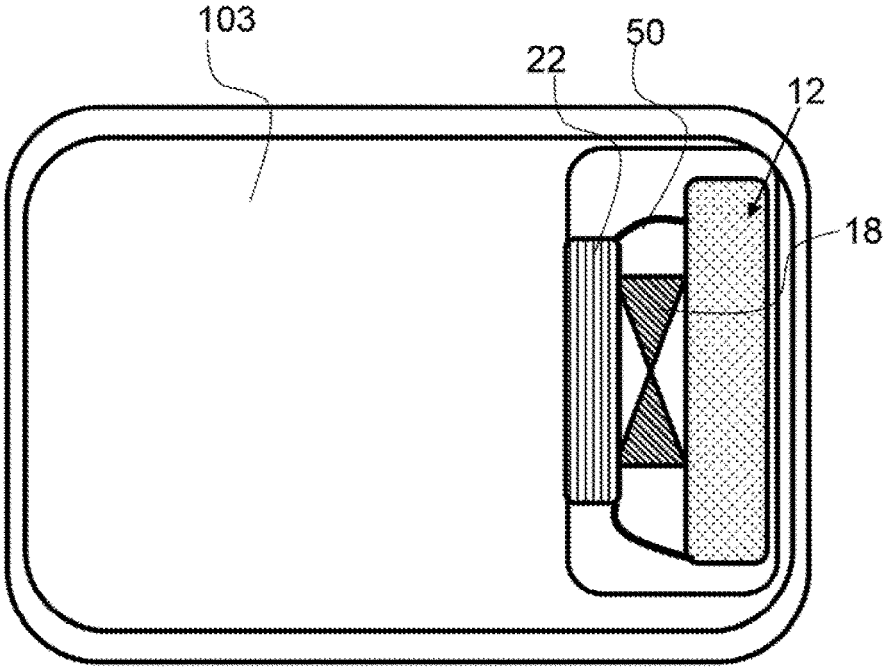

FIG. 12 shows an exemplary electrochemical heat transfer system configured to heat an enclosure, or heat reservoir.

DETAILED DESCRIPTION OF THE ILLUSTRATED EMBODIMENTS

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to, such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations modifications, improvements are within the scope of the present invention.

Figure 1:
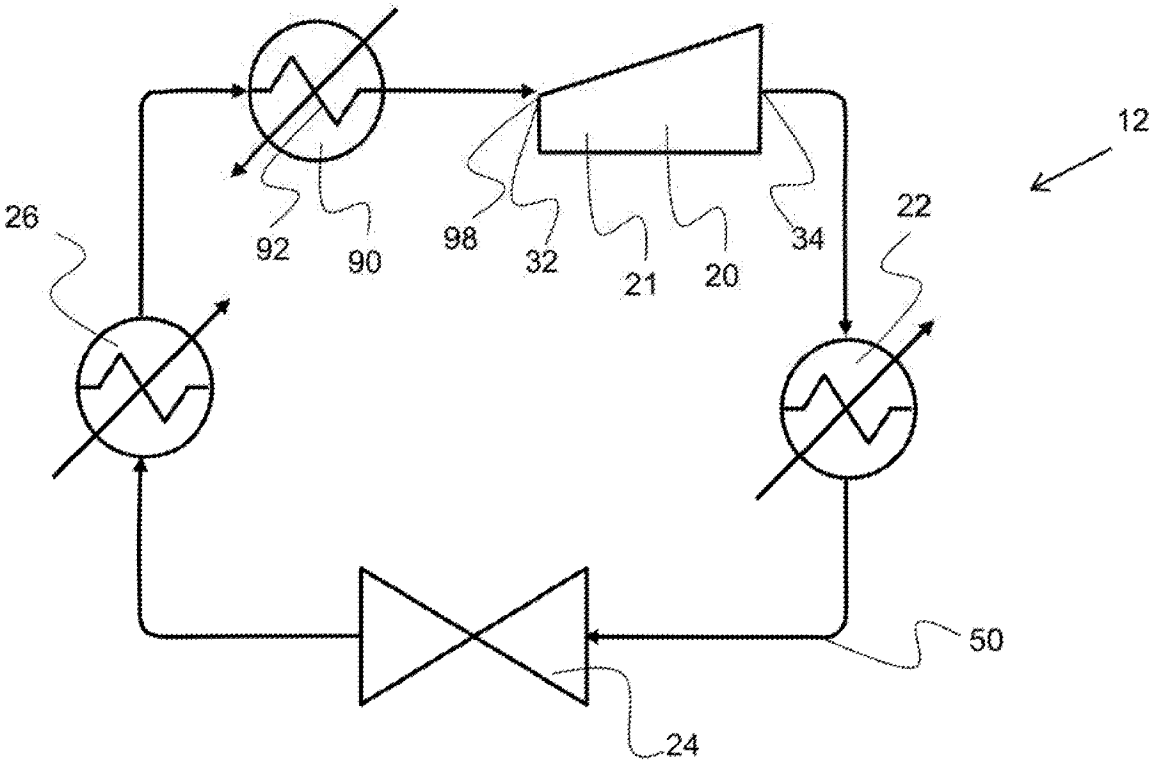
FIG. 1 shows a diagram of an electrochemical heat transfer system comprising an electrochemical compressor that incorporates a preheater.

As shown in FIG. 1, an electrochemical heat transfer system comprises an electrochemical compressor and a preheater that heats a working fluid prior to the electrochemical compressor. The preheater is configured to heat a working fluid to a superheated temperature delta, as described herein. FIG. 1 shows the direction of flow of the working fluid in the electrochemical heat transfer system 12. The flow of the working fluid is from the exit 34 of the electrochemical compressor 21 to the condenser 22, then from the condenser to the expansion valve 24, then from the condenser to the evaporator 26 then from the evaporator to the preheater 90, and finally from the preheater to the inlet 32 of the electrochemical compressor 21. The electrochemical compressor contains one or more electrochemical cells 20. The preheater is upstream of the electrochemical compressor, meaning the flow of working fluid is from the preheater to the electrochemical compressor. Likewise, the evaporator is upstream of the preheater, the expansion valve is upstream of the evaporator, the condenser is upstream of the expansion valve and the electromical compressor is upstream of the condenser.

Figure 2:
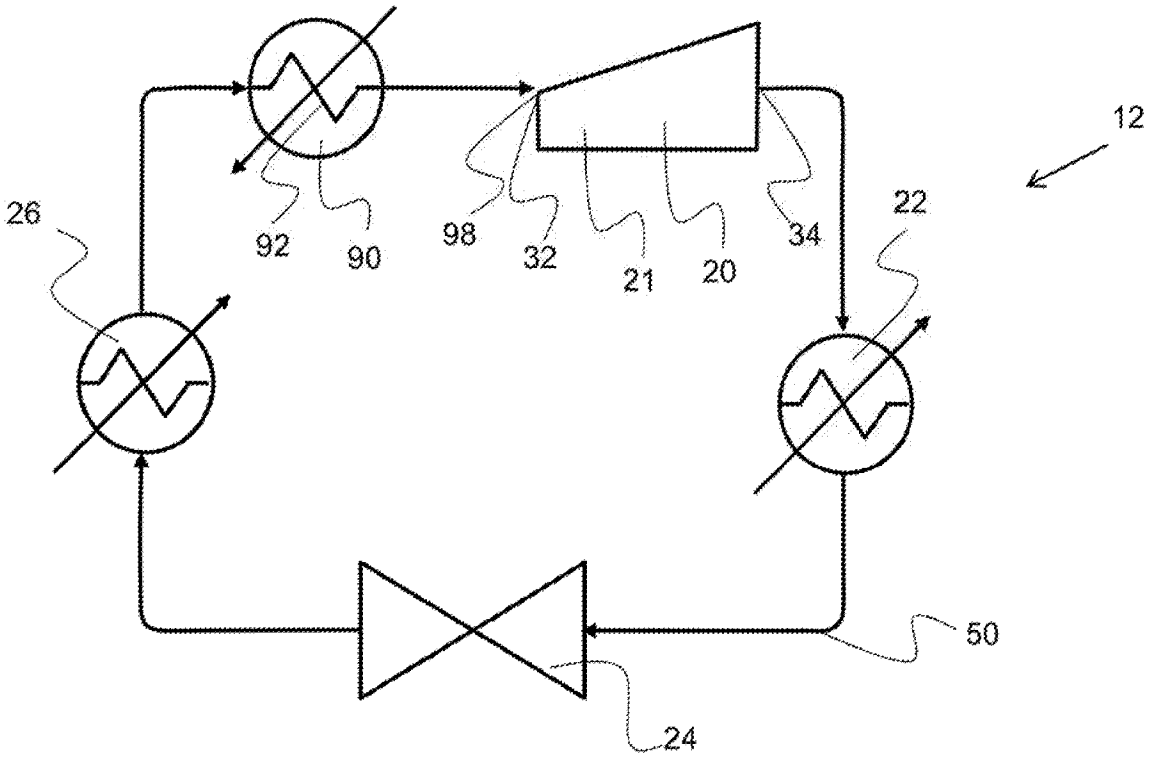
FIG. 2 shows diagram of an electrochemical heat transfer system comprising an electrochemical compressor that incorporates a preheater and a chart of the temperature and pressures of a working fluid as it passes through the system.

As shown in FIG. 2, an electrochemical heat transfer system comprises an electrochemical compressor and a preheater. A chart of the temperature and pressures of a working fluid as it passes through the system is provided below the diagram. For example, if the electrochemical heat transfer system were operated as a hot water heater with water as the electrochemically active working fluid, the temperature in the following components would be as follows: temperature in the evaporator may be around 20° C., temperature in the compressor may be around 65° C., and the preheater must raise the temperature of the electrochemically active working fluid above 65° C., or from about 20° C. to greater than 65° C. In one embodiment, the preheater might raise the temperature of the electrochemically active working fluid to 80° C., or to superheated temperature delta of about 15° C. in this water heater example. In another example, if the electrochemical heat transfer system were operated as a freezer or refrigerator with ammonia as the refrigerant, the electrochemical working fluid temperature in the following components would be as follows: temperature in the freezer may be about −30° C., temperature in the compressor may be about 10° C., and the preheater must raise the temperature of the electrochemically active working fluid above both the freezing temperature of water so no freezing occurs during compression and above the ammonia condensation temperature at the compressor pressure so condensation doesn't occur in the compressor.

Figure 3:
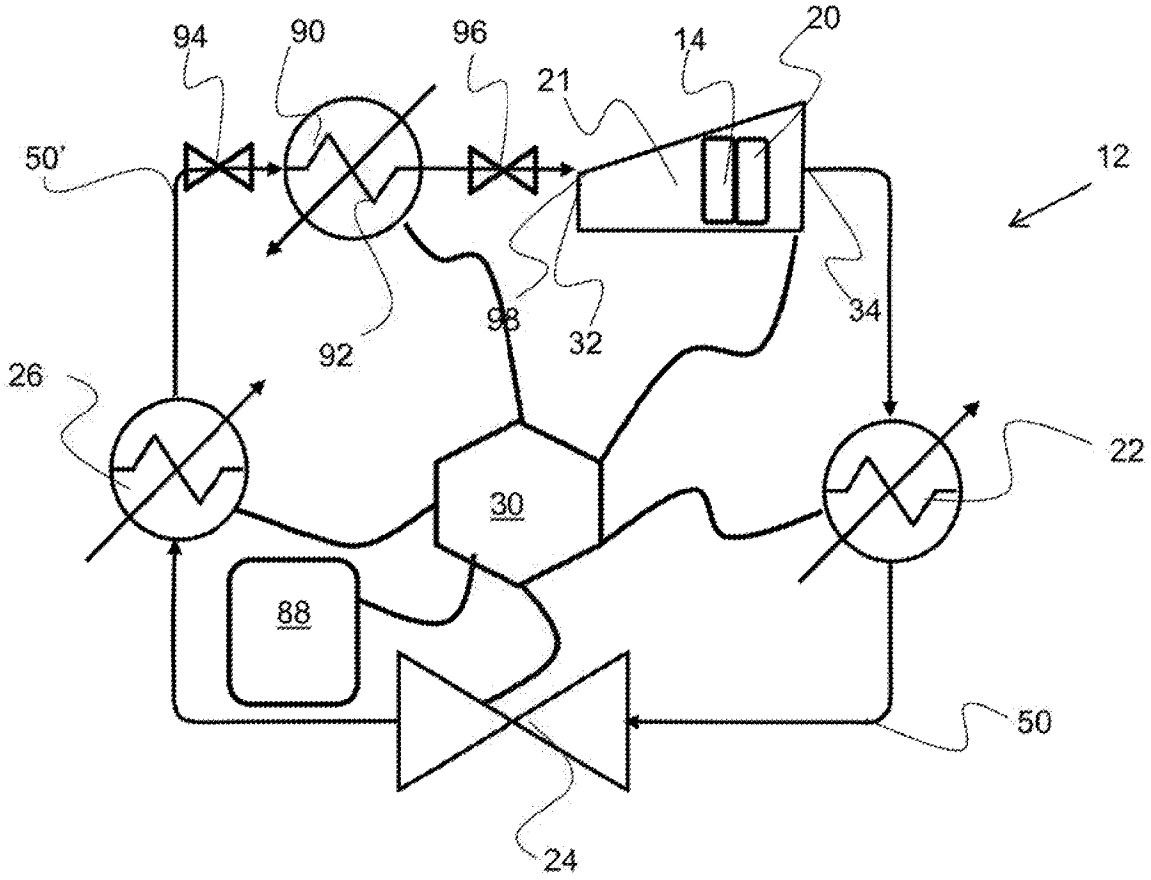
FIG. 3 shows diagram of an electrochemical heat transfer system comprising an electrochemical compressor, preheater and an inlet valve.

As shown in FIG. 3, an electrochemical heat transfer system 12 comprises a condenser 22, expansion valve 24, evaporator 26, electrochemical compressor 21, preheater 90 and a one-way inlet valve 96. The preheater 90 comprises a heating element 92 and is configured between the evaporator 26 and the electrochemical compressor. The preheater is configured to heat the working fluid to a superheated temperature delta. A second valve 94 is configure upstream or before the preheater and may be used to trap and enclose working fluid within a preheater. The system also comprises a control system 30, that may comprise a microprocessor for controlling the functions of the system including the power delivered to the electrochemical compressor and the opening and closing of valves. An interface 88, such as a temperature set-point or thermostat may be coupled with the control system to enable a user to select a desired temperature. The control system may take this input and then control the system to increase or decrease the temperature as required. The control system may close both the valves shown 94 and 96 to enclose electrochemically active working fluid for heating.

As shown in FIG. 4, an electrochemical heat transfer system 12 comprises a preheater 90 within an inlet chamber 98. A preheater may be configured within or coupled to an inlet chamber to heat the electrochemically active working fluid prior to introduction into the electrochemical compressor. As shown in FIG. 4 the inlet chamber is directly coupled with the electrochemical compressor 21. A chamber for preheating the electrochemically active working fluid may be couple with the electrochemical compressor by a conduit however and a valve may be configured between the two components of the system. The electrochemical compressor 21 comprises a fuel cell having two electrochemical cells 20.

As shown in FIG. 5, an electrochemical heat transfer system 12 comprises, an electrochemical compressor 21, preheater 90, inlet chamber 98 and inlet valve 94. The inlet chamber is coupled to the electrochemical compressor or electrochemical cell by a conduit 50 and a one-way valve 96 ensures that the electrochemically active working fluid only flows from the preheater into the electrochemical cell. A second valve 94 is configure before the preheater and may be used to create a preheater enclosure out of the inlet chamber 98, when the two valves 94 and 94' are closed. A control system may also include a thermometer and a temperature controller to modulate heating of the electrochemically active working fluid to maintain a set or required temperature.

As shown in FIG. 6, an electrochemical heat transfer system 12 comprises an electrochemical compressor 21, preheater 90, inlet chamber 98 and a waste heat device 93. The waste heat device provides heat from the condenser 22 to the preheater. For example, a flow of water may be draw heat from the condenser and provide this heat to the preheater.

As shown in FIG. 7, an electrochemical compressor 21 comprises a fuel cell 14 having a anode 46, a ion conductive membrane 49 and a cathode 48. Water is introduced on the anode side 45 and is converted into protons, $H^+$, that are transported across the ion conducting membrane 49 to the cathode side 47. A gas diffusion media 70, 70' is configured in direct and electrical contact with the anode and cathode respectively. An exemplary fuel cell 14 comprises an electrochemical cell 20. The fuel cell comprises a membrane electrode assembly 42 comprising a proton conducting membrane 49, an anode 46 and cathode 48. A membrane electrode assembly may in some cases include a gas diffusion media 70, 70'. A flow field 72, 72', typically comprising an electrically conductive plate having channels for the delivery of gasses to the surface of the membrane electrode assembly, is configured on either side of the membrane electrode assembly. The anode side 45 of the fuel cell converts hydrogen to protons, $H^+$, which are then transported across the membrane to the cathode side 47. At the cathode, the protons react with oxygen to produce water and the water produced moves through the compressor outlet 52 and into conduit 50. This transfer, or pumping, of protons across the membrane produces an increased pressure on the cathode side. The anode side 45 is the low pressure side 43, and the cathode side 47 is the high pressure side 44 of the electrochemical compressor 20. The hydrogen inlet 40 and oxygen inlet 41 are shown As shown in FIG. 8, an exemplary electrochemical cell 20 comprises a flow-field 72 on the anode side with a preheater 90 configured to heat the flow field. The heating element is a rod heater 92 that extends into the flow field. The flow channels 73 of the flow-field 72 may be heated and the small volume to surface ratio of the flow channels may effectively and efficiently preheat the electrochemically active working fluid 19 just prior to introduction to the anode 46.

As shown in FIG. 9, an exemplary flow-field 72 is configured with a preheater heater element 92 within the flow channels 73. A heating element may be configured within the flow channels 73 and in direct contact with the electrochemically active working fluid 19. This configuration may be very efficient in preheating the electrochemically active working fluid to a superheated temperature delta.

As shown in FIG. 10, an electrochemical compressor 21 has a preheater 90 in an inlet chamber 98. The heating element 92 is within the interior volume of the inlet chamber. A heater may be configured in contact with the inlet chamber and configured around a portion of the outside of the chamber however.

As shown in FIG. 11, shows an exemplary electrochemical heat transfer system 12, as described herein, configured in a refrigerator 102. The temperature of the enclosure 103 or the refrigerator may be changed by heat transfer from the electrochemical heat transfer system. A fan 18 is configured to blow air over the evaporator 26, a heat transfer device, of the electrochemical heat transfer system to cool the enclosure. The enclosure 103 is a heat reservoir that transfers heat from reservoir to the working fluid. A condenser 22, another heat transfer device is configured to transfer heat form the working fluid outside of the enclosure.

As shown in FIG. 12, an exemplary electrochemical heat transfer system 22 is configured to heat an enclosure 103, or heat reservoir. The temperature of the enclosure 103 may be changed by heat transfer from the electrochemical heat transfer system. A fan 18 is configured to blow air over the condenser 22, a heat transfer device, of the electrochemical heat transfer system to heat the enclosure. Heat from the working fluid is transferred into the enclosure, or heat reservoir. The enclosure may be a room within a dwelling, the interior of a vehicle and the like.

The electrochemical compressor raises the pressure of the working fluid which is then delivered, to a condenser where the condensable component is precipitated by heat exchange with a sink fluid. The working fluid, is then reduced in pressure in a thermal expansion valve. Subsequently, the low pressure working fluid is delivered to an evaporator where the condensed phase of the working fluid is boiled by heat exchange with a source fluid. The evaporator effluent working fluid may be partially in the gas phase and partially in the liquid phase when it is returned from the evaporator to the electrochemical compressor. In the process, heat energy is transported from the evaporator to the condenser and consequently, from the heat source at low temperature to the heat sink at high temperature.

In an exemplary embodiment, the membrane electrode assembly (MEA) utilized in the electrochemical compressor is a classical ionomer membrane with electrodes attached, a membrane electrode assembly, or MEA. The membrane electrode assembly functions as a compressor component in a traditional four-stage refrigeration cycle system.

A cell assembled with the components identified above, is then combined to form an electrochemical compressor device and then subsequently used in a variety of different refrigeration cycles, such as for example, in a refrigerator, or heat pump, or automobile, or electronic cooling application.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An electrochemical compressor system through which an electrochemically active working fluid flows, the electrochemical compressor system comprising:

a. an electrical power supply;

b. one or more electrochemical cells electrically connected to each other through the power supply, each electrochemical cell comprising:

i. a gas pervious anode, ii. a gas pervious cathode, iii. an electrolyte disposed between and in intimate electrical contact with the cathode and the anode;

c. an electrochemical compressor input;

d. an electrochemical compressor output;

e. a conduit configured in a closed loop to transfer a working fluid from the electrochemical compressor output to the electrochemical input;

wherein the working fluid comprises a condensable refrigerant;

wherein the working fluid comprises an electrochemically active fluid that participates in the electrochemical process within the electrochemical compressors;

f. a preheater configured proximal to the electrochemical compressor input and configured to heat the working fluid to a superheated temperature delta of at least 5° C.;

wherein said superheated temperature delta is a temperature difference above a vaporization temperature of the working fluid at an absolute pressure;

wherein an output pressure on the electrochemical compressor output is greater than an input pressure on the electrochemical compressor input.

2. The electrochemical compressor system of claim 1, wherein the superheated temperature delta is between 5° C. and 30° C.

3. The electrochemical compressor system of claim 1, wherein the electrochemically active working fluid comprises hydrogen and water.

4. The electrochemical compressor system of claim 1, wherein the electrochemically active working fluid consists essentially of a single component that is both electrochemically active and is a refrigerant.

5. The electrochemical compressor system of claim 1, wherein the working fluid is a proton associable compound.

6. The electrochemical compressor system of claim 1, wherein the working fluid comprises a low molecular weight alcohol.

7. The electrochemical compressor system of claim 1, wherein the working fluid comprises ammonia.

8. The electrochemical compressor system of claim 1, wherein the preheater comprises an electrically resistive heating element.

9. The electrochemical compressor system of claim 1, comprising an inlet chamber upstream of the electrochemical cell for receiving the electrochemically active working fluid.

10. The electrochemical compressor system of claim 9, wherein the preheater is configured upstream to the inlet chamber.

11. The electrochemical compressor system of claim 9, wherein the preheater is configured to heat the working fluid within the inlet chamber.

12. The electrochemical compressor system of claim 1, wherein electrochemical compressor comprises a flow-field to distribute the working fluid to the gas pervious anode and wherein the preheater is configured to heat at least a portion of the flow-field.

13. The electrochemical compressor system of claim 12, wherein the flow field is heated by an electrically resistive heater element.

14. The electrochemical compressor system of claim 1, wherein the electrochemical compressor is configured within a housing that defines an enclosure between a first and second heat transfer devices.

15. The electrochemical compressor system of claim 14, wherein the housing is a hermetically-sealed housing.

16. A heat transfer system that conveys heat from a first heat reservoir at a low temperature to a second heat reservoir at a high temperature, the refrigeration system defining a closed loop that contains a working fluid, at least part of the working fluid being circulated through the closed loop, the refrigeration system comprising:

a. a first heat transfer device that transfers heat from the first heat reservoir to the working fluid;

b. a second heat transfer device that transfer heat from the working fluid to the second heat reservoir, c. an expansion valve between the first and second heat transfer devices that reduces the pressure of the working fluid, d. a conduit system; for the working fluid;

e. an electrochemical compressor comprising:

i. an electrical power supply;

ii. one or more electrochemical cells electrically connected to each other through the power supply, each electrochemical cell comprising:

1. a gas pervious anode, 2. a gas pervious cathode, 3. an electrolyte disposed between and in intimate electrical contact with the cathode and the anode;

iii. an electrochemical compressor input;

iv. an electrochemical compressor output;

v. a closed loop configured to transfer a working fluid from the electrochemical compressor output to the electrochemical input;

wherein the working fluid comprises a condensable refrigerant;

wherein the working fluid comprises an electrochemically active fluid that participates in the electrochemical process within the electrochemical compressor;

f. a preheated configured proximal to the electrochemical compressor input and configured to heat the working fluid to a superheated temperature delta of at least 5° C.;

wherein said superheated temperature delta is a temperature difference above a vaporization temperature of the working fluid at an absolute pressure;

wherein an output pressure on the electrochemical compressor output is greater than an input pressure on the electrochemical compressor input.

17. The heat transfer system of claim 16, wherein the electrochemically active working fluid comprises hydrogen and water.

18. The heat transfer system of claim 16, wherein the electrochemically active working fluid consists essentially of a single component that is both electrochemically active and is a refrigerant.

19. The heat transfer system of claim 16, comprising an inlet chamber for receiving the electrochemically active working fluid wherein the preheater is configured to heat the working fluid within the inlet chamber.

20. The heat transfer system of claim 16, wherein electrochemical compressor comprises a flow-field to distribute the working fluid to the gas pervious anode and wherein the preheater is configured to heat at least a portion of the flow-field.

21. The heat transfer system of claim 16, wherein the electrochemical compressor is configured within a housing that defines an enclosure between a first and second heat transfer devices;

wherein the housing is a hermetically-sealed housing.

22. A method of transferring heat utilizing an electrochemical compressor comprising the steps of:

a. providing a heat transfer system that conveys heat from a first heat reservoir at a low temperature to a second heat reservoir at a high temperature, the heat transfer system defining a closed loop that contains a working fluid, at least part of the working fluid being circulated through the closed loop, the refrigeration system comprising:

i. a first heat transfer device that transfers heat from the first heat reservoir to the working fluid;

ii. a second heat transfer device that transfer heat from the working fluid to the second heat reservoir, iii. an expansion valve between the first and second heat transfer devices that reduces the pressure of the working fluid, iv. a conduit system; for the working fluid;

v. an electrochemical compressor comprising:

1. an electrical power supply;

2. one or more electrochemical cells electrically connected to each other through the power supply, each electrochemical cell comprising:

a. a gas pervious anode, b. a gas pervious cathode, c. an electrolyte disposed between and in intimate electrical contact with the cathode and the anode;

3. an electrochemical compressor input;

4. an electrochemical compressor output;

5. a closed loop configured to transfer a working fluid from the electrochemical compressor output to the electrochemical input;

wherein the working fluid comprises a condensable refrigerant;

wherein the working fluid comprises an electrochemically active fluid that participates in the electrochemical process within the electrochemical compressor;

vi. a preheated configured proximal to the electrochemical compressor input and configured to heat the working fluid to a superheated temperature delta of at least 5° C.;

wherein said superheated temperature delta is a temperature difference above a vaporization temperature of the working fluid at an absolute pressure;

wherein an output pressure on the electrochemical compressor output is greater than an input pressure on the electrochemical compressor input;

b. flowing the electrochemically active working fluid through the closed loop conduit;

c. preheating the electrochemically active working fluid to a superheated temperature of at least 5° C.;

d. compressing the electrochemically active working fluid through the electrochemical compressor;

e. condensing a portion of the electrochemically active working fluid into a liquid in the condenser; and f. evaporating the electrochemically active working fluid into a gas in the evaporator.

* * * * *